US008984841B1

(12) United States Patent
Nabeel

(10) Patent No.: US 8,984,841 B1
(45) Date of Patent: Mar. 24, 2015

(54) LOW COST ROOFING TECHNIQUES

(71) Applicant: UMM Al-Qura University, Makkah (SA)

(72) Inventor: Khaled Nabeel, Makkah (SA)

(73) Assignee: Umm Al-Qura University, Makkah (SA)

( * ) Notice: Subject to any disclaimer, the term of this patent is extended or adjusted under 35 U.S.C. 154(b) by 0 days.

(21) Appl. No.: 14/198,133

(22) Filed: Mar. 5, 2014

(51) Int. Cl.
*E04G 21/00* (2006.01)
*E04B 7/00* (2006.01)

(52) U.S. Cl.
CPC ..... *E04B 7/00* (2013.01)
USPC ..... 52/745.06

(58) Field of Classification Search
USPC ..... 52/745.06, 745.07, 745.08, 745.2, 52/745.01, 82, 83, 80.1, 80.2, 81.1, 81.2, 52/81.4
See application file for complete search history.

(56) References Cited

U.S. PATENT DOCUMENTS 3,047,931 A * 8/1962 Boettner ..... 249/18
3,180,057 A * 4/1965 Pritzker ..... 52/246
3,225,413 A * 12/1965 Bird et al. ..... 425/438
3,276,171 A * 10/1966 Brown ..... 52/86
4,041,671 A 8/1977 Nicholson
7,743,582 B1 6/2010 Yaksic
8,357,240 B2 * 1/2013 Sweat et al. ..... 106/713
2006/0277837 A1 * 12/2006 Wilsey ..... 52/79.1
2009/0078161 A1 * 3/2009 Woolfsmith et al. ..... 106/692
2009/0081446 A1 * 3/2009 Woolfsmith et al. ..... 428/323
2011/0214386 A1 * 9/2011 Austin et al. ..... 52/745.06
2011/0214391 A1 * 9/2011 Guevara et al. ..... 52/800.1
2011/0258963 A1 * 10/2011 Sultan ..... 52/745.05
2012/0085053 A1 * 4/2012 Barone ..... 52/302.1
2012/0312193 A1 * 12/2012 Jezequel et al. ..... 106/678
2012/0318171 A1 * 12/2012 Jezequel et al. ..... 106/676

* cited by examiner

*Primary Examiner* — Joshua J Michener
*Assistant Examiner* — Keith Minter
(74) *Attorney, Agent, or Firm* — Richard C. Litman

(57) ABSTRACT

The low cost roofing techniques provide techniques for construction of low-cost roofing. The techniques reduce the proportion of cement by employing substitute (low-cost) materials that may be readily available to mix with the cement. These substitute materials include, but are not limited to, suitable agricultural wastes, such as rice husk ash, crushed used brick rubble, and pozzolana. The techniques involve forming a plurality of supports spanning the open space between the walls of the structure and mounting a plurality of dome-shaped sheet metal elements on the supports, forming a series of ceiling vaults. The concave surface of the dome-shaped elements forms the ceiling. The convex or outer surface of the dome-shaped elements forms the inner layer of the roof. The cement mixture is deposited on the convex or outer surfaces of the dome-shaped elements to form a second layer for the roof.

6 Claims, 3 Drawing Sheets

LOW COST ROOFING TECHNIQUES

BACKGROUND OF THE INVENTION

1. Field of the Invention

The present invention relates to building construction techniques, and particularly to low cost roofing techniques for providing economical roofs for buildings.

2. Description of the Related Art

In many countries, shortages of quality building materials and skilled labor render construction costs of adequate and safe housing prohibitive. To allay this situation, some countries have promoted policies that encourage low-income individuals and families to self-construct (do-it-yourself). Adoption of such policies, however, is insufficient if the technology is not available to assist the (mostly unskilled) individuals in the construction of safe, building standard-compliant, and relatively low-cost dwellings. This is especially true when attempting to construct a roof for a home or building. Generally, the home or building structure to be erected is limited to two stories in height so that conventional ladders may be utilized when constructing the roof. The building industry would certainly welcome techniques for constructing a roof that would enable unskilled laborers to employ low-cost materials to construct a building standard-compliant and serviceable roof for a home or building. Thus, low cost roofing techniques solving the aforementioned problems is desired.

SUMMARY OF THE INVENTION

The low cost roofing techniques provide techniques for construction of low-cost roofing. It has been determined that iron or steel reinforcement and cement are the major cost elements for materials in traditional roof construction, amounting to about 59% of the total costs. The labor costs amount to about 12% of the total. Since labor costs for do-it-yourself construction would be negligible, the solution to the problem is to (1) reduce the proportion of iron or steel as low as possible based on the content of the cement, and (2) reduce the proportion of cement by employing substitute (low-cost) materials that may be readily available to mix with the cement. These substitute materials include, but are not limited to, suitable agricultural wastes, such as rice husk ash, crushed used brick rubble, and pozzolana. Mixing these low-costs materials (based on availability) with cement in proper, predetermined proportions would reduce the amount of cement needed. The technique involves forming a plurality of supports spanning the open space between the walls of the structure and mounting a plurality of dome-shaped sheet metal elements on the supports, forming a series of ceiling vaults. The concave surface of the dome-shaped elements would form the ceiling. The convex or outer surface of the dome shaped elements would form the inner layer of the roof. The cement mixture would be deposited on the convex or outer surfaces of the dome-shaped elements to form a second layer for the roof.

Accordingly, the invention presents techniques for constructing a building standard-compliant roof, the techniques being easy to accomplish and readily employed by unskilled laborers. The invention provides improved elements and arrangements thereof for the purposes described which are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
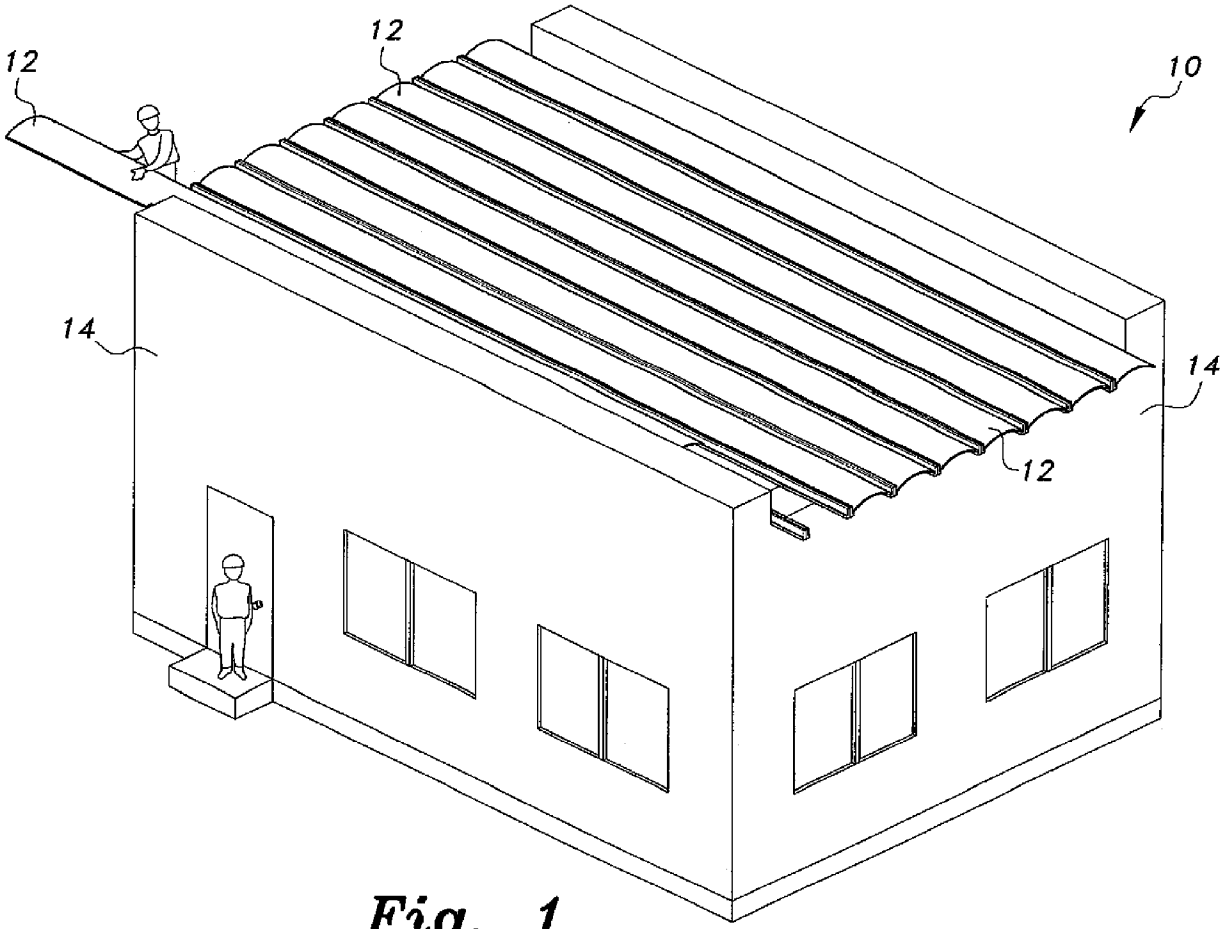
FIG. 1 is an environmental, perspective view of a roof being installed using low cost roofing techniques according to the present invention.
Figure 2:
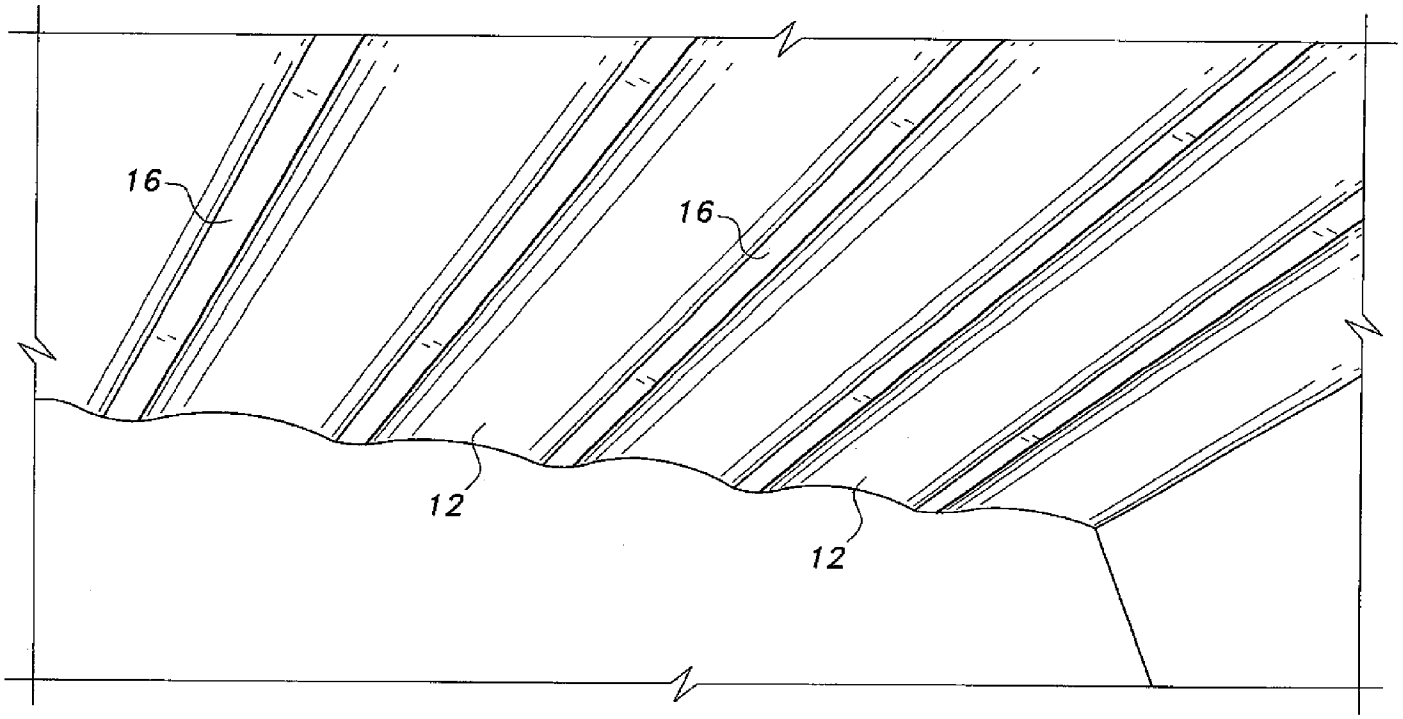
FIG. 2 is a partial, perspective view of a domed ceiling built using low-cost roofing techniques according to the present invention, shown from below.
Figure 3:
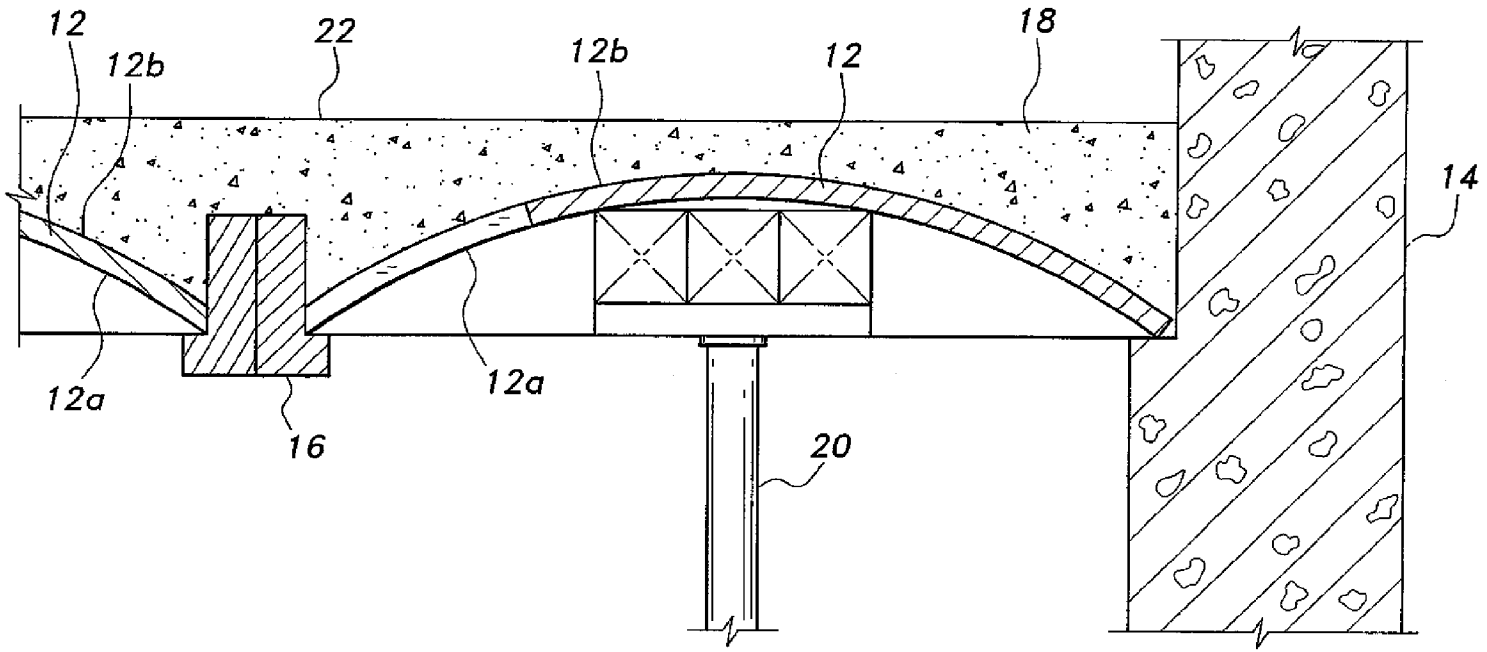
FIG. 3 is a partial front view in section of a roof employing low cost roofing techniques according to the present invention.

With reference to FIGS. 1-3, the low cost roofing techniques involve supporting a plurality of arched or dome-shaped sheet metal elements 12 across an open space defined by the walls 14 of the building, generally indicated at 10, that is being constructed. At least one side of each element 12 is supported on a support member 16, the support members 16 extending in parallel between opposing walls 14. The concave face 12*a* of element 12 forms the ceiling of the structure. The convex face 12*b* of element 12 functions as an inner layer for the roof. The support members 16 comprise a 1:1 mixture of poured red brick and lime pozzolana ash. Wooden forms are used to contain the mixture until it hardens. A layer of the concrete mixture 18, as described above (i.e., rice husk ash, crushed used brick rubble, and pozzolana mixed with cement), is deposited on the convex surfaces 12*b* of elements 12 to form the roof of the building. Pillars 20 (only one is shown) are employed to prevent deflection of the elements during casting of the mixture. The pillars are removed after the concrete sets. The top surface 22 of the cement can be finished with colorful paints, or a layer of broken red brick may be added for insulation purposes.

It is to be understood that the present invention is not limited to the embodiment described above, but encompasses any and all embodiments within the scope of the following claims.

I claim:

1. A method of constructing a concrete roof, comprising the steps of:

providing walls forming a periphery of a building, the walls enclosing an inner area of the building, the area having an open top;

installing a plurality of parallel elongate support members spanning the area across the open top;

installing a plurality of adjacent elongate dome-shaped metal elements spanning the area across the open top, each of the dome-shaped elements having a convex upper surface and a concave lower surface, the dome-shaped elements having adjacent opposing elongate edges supported on the elongate support members;

forming a cement mixture;

applying a layer of the cement mixture to directly cover the upper convex surfaces of the elongate dome-shaped elements to form a roof for the building, the cement layer having a top surface; and applying a covering layer to the top surface of the cement layer.

2. The method of constructing a concrete roof according to claim 1, wherein said step of forming a cement mixture includes the step of mixing cement with an agricultural waste.

3. The method of constructing a concrete roof according to claim 1, wherein said step of forming a cement mixture includes the step of mixing cement with used crushed brick.

4. The method of constructing a concrete roof according to claim 1, wherein said support members are formed from a mixture of poured red brick and lime pozzolana ash.

5. The method of constructing a concrete roof according to claim 1, wherein said covering layer is formed from broken red brick.

6. The method of constructing a concrete roof according to claim 1, wherein said covering layer is formed from paint.

* * * * *